US011295666B2

(12) United States Patent
Jiang et al.

(10) Patent No.: US 11,295,666 B2
(45) Date of Patent: Apr. 5, 2022

(54) METHOD FOR DRIVING A PIXEL CIRCUIT WITH FEEDBACK COMPENSATION, A CIRCUIT FOR DRIVING A LIGHT-EMITTING DEVICE, AND A DISPLAY APPARATUS

(71) Applicants: HEFEI BOE OPTOELECTRONICS TECHNOLOGY CO., LTD., Anhui (CN); BOE Technology Group Co., Ltd., Beijing (CN)

(72) Inventors: Ran Jiang, Beijing (CN); Hai Kang, Beijing (CN); Donghui Wang, Beijing (CN); Chengchen Yan, Beijing (CN); Shengfei Ma, Beijing (CN)

(73) Assignees: HEFEI BOE OPTOELECTRONICS TECHNOLOGY CO., LTD., Anhui (CN); BOE Technology Group Co., Ltd., Beijing (CN)

( * ) Notice: Subject to any disclaimer, the term of this patent is extended or adjusted under 35 U.S.C. 154(b) by 355 days.

(21) Appl. No.: 16/476,976

(22) PCT Filed: Aug. 16, 2018

(86) PCT No.: PCT/CN2018/100803
§ 371 (c)(1),
(2) Date: Jul. 10, 2019

(87) PCT Pub. No.: WO2020/034140
PCT Pub. Date: Feb. 20, 2020

(65) Prior Publication Data
US 2021/0335232 A1 Oct. 28, 2021

(51) Int. Cl.
*G09G 3/3233* (2016.01)

(52) U.S. Cl.
CPC ... *G09G 3/3233* (2013.01); *G09G 2300/0819* (2013.01); *G09G 2310/0264* (2013.01); *G09G 2320/045* (2013.01)

(58) Field of Classification Search
None
See application file for complete search history.

(56) References Cited

U.S. PATENT DOCUMENTS

2008/0122760 A1 5/2008 Levey et al.
2009/0166508 A1 7/2009 Huang et al.
(Continued)

FOREIGN PATENT DOCUMENTS

CN 102163402 A 8/2011
CN 106504707 A 3/2017
(Continued)

OTHER PUBLICATIONS

International Search Report & Written Opinion dated May 15, 2019, regarding PCT/CN2018/100803.

*Primary Examiner* — Matthew Yeung
(74) *Attorney, Agent, or Firm* — Intellectual Valley Law, P.C.

(57) ABSTRACT

The present application discloses a method for driving a pixel circuit. The method includes initializing a voltage setting in a pixel circuit including at least a driving transistor coupled to a light-emitting device and obtaining a first threshold voltage of the driving transistor. The method further includes inputting a first data voltage to the pixel circuit to generate a first driving current independent of the first threshold voltage, to drive light emission of the light-emitting device in a current cycle. Additionally, the method includes generating a compensation voltage via a feedback sub-circuit based on a change of the first driving current upon a second threshold voltage of the light-emitting device. Furthermore, the method includes inputting a second data
(Continued)

voltage combined with the compensation voltage as a negative feedback to generate a second driving current to drive light emission of the light-emitting device in a next cycle.

15 Claims, 2 Drawing Sheets

(56) References Cited

U.S. PATENT DOCUMENTS

| | | | | |
|---|---|---|---|---|
| 2011/0205250 | A1 | 8/2011 | Yoo et al. | |
| 2015/0109278 | A1* | 4/2015 | Kim | G09G 3/3266 345/211 |
| 2018/0061314 | A1* | 3/2018 | Kim | G09G 3/3233 |
| 2018/0322829 | A1 | 11/2018 | Xie | |

FOREIGN PATENT DOCUMENTS

| | | | |
|---|---|---|---|
| CN | 106991965 | A | 7/2017 |
| CN | 108711400 | A | 10/2018 |
| EP | 3028545 | B1 | 5/2017 |

* cited by examiner

METHOD FOR DRIVING A PIXEL CIRCUIT WITH FEEDBACK COMPENSATION, A CIRCUIT FOR DRIVING A LIGHT-EMITTING DEVICE, AND A DISPLAY APPARATUS

CROSS-REFERENCE TO RELATED APPLICATION

This application is a national stage application under 35 U.S.C. § 371 of International Application No. PCT/CN2018/100803, filed Aug. 16, 2018, the contents of which are incorporated by reference in the entirety.

TECHNICAL FIELD

The present invention relates to display technology, more particularly, to a method for driving a pixel circuit with feedback compensation, a circuit for driving a light-emitting device, and a display apparatus having the same.

BACKGROUND

Organic Light Emitting Diode (OLED) display has many advantages including wider view angles, greater brightness, higher contrast, lower power consumption, thinner physical thickness over the many conventional display technologies. Low Temperature Poly Silicon (LIPS) substrate with its fast electron mobility characteristics has become a popular substrate for making thin-film transistors based pixel driving circuit for driving light emission of each OLED associated with each sub-pixel in the display panel. In real OLED display apparatus, every thin-film transistor formed in the display panel may not have uniform characteristics in threshold voltage, carrier mobility, or resistor series, leading to non-uniform variations in image display across the display panel. In addition, OLED as a sub-pixel light source is a diode. The V-I characteristics of the diode may be drifted due to changes of environment or working hours, also leading to unwanted variation in image display.

SUMMARY

In an aspect, the present disclosure provides a method for driving a pixel circuit with feedback compensation in consecutive cycles. The method includes initializing a voltage setting in the pixel circuit including at least a driving transistor coupled to a light-emitting device and obtaining a first threshold voltage of the driving transistor. The method further includes inputting a first data voltage from a data voltage terminal to the pixel circuit to generate a first driving current independent of the first threshold voltage, to drive light emission of the light-emitting device for displaying a pixel image in a current cycle. Additionally, the method includes generating a compensation voltage via a feedback sub-circuit coupled between the data voltage terminal and the light-emitting device based on a change of the first driving current due to a change of a second threshold voltage of the light-emitting device. Furthermore, the method includes inputting a second data voltage from the data voltage terminal combined with the compensation voltage as a negative feedback to generate a second driving current to drive light emission of the light-emitting device for displaying a pixel image in a next cycle.

Optionally, each of the current cycle and the next cycle is one of two consecutive durations for the light-emitting device to emit light for producing two consecutive frames of pixel images under a progressive scanning scheme, each duration comprising consecutively a first period, a second period, a third period, and a fourth period.

Optionally, the initializing the pixel circuit includes releasing charges in a source electrode of the driving transistor in the first period of the current cycle. The source electrode is coupled to an anode of the light-emitting device.

Optionally, the obtaining a first threshold voltage of the driving transistor includes setting a voltage level at a first electrode of a first capacitor in the pixel circuit to a first reference voltage in the second period of the current cycle and storing the first threshold voltage as a voltage difference between the first electrode and a second electrode of the first capacitor. The first electrode of the first capacitor is coupled to a gate electrode of the driving transistor.

Optionally, the inputting a first data voltage includes transferring the first data voltage to the second electrode of the first capacitor in the third period of the current cycle and resetting the voltage level at the first electrode of the first capacitor to a sum of the first data voltage and the first threshold voltage.

Optionally, the resetting the voltage level at the first electrode of the first capacitor includes making the voltage level at the source electrode of the driving transistor to at least a second threshold voltage in the fourth period of the current cycle and generating the first driving current through the driving transistor.

Optionally, the generating a compensation voltage includes using a first resistor to obtain a first sampling voltage equal to the first driving current multiplying a resistance of the first resistor in the fourth period of the current cycle. Additionally, the generating the compensation voltage includes inputting the first sampling voltage to a first positive input terminal of a first voltage-difference comparator in the feedback sub-circuit. Furthermore, the generating the compensation voltage includes coupling the first data voltage to a fust negative input terminal of the first voltage-difference comparator to output a first voltage difference between the first sampling voltage and the first data voltage.

Optionally, the method further includes inputting the first voltage difference to a second negative input terminal of a second voltage-difference comparator in the feedback sub-circuit. Additionally, the method includes coupling a second reference voltage to a second positive input terminal of the second voltage-difference comparator. Moreover, the method includes outputting a second voltage difference between the second reference voltage and the first voltage difference. The second voltage difference is proportional to the change of the first driving current due to the change of the second threshold voltage of the light-emitting device.

Optionally, the method further includes coupling the second voltage difference as the compensation voltage to the data voltage terminal to be added with the second data voltage.

Optionally, the compensation voltage is zero when the second threshold voltage remains substantially unchanged. The compensation voltage is a negative value to compensate an increasing driving current when the second threshold voltage decreases. The compensation voltage is a positive value to compensate a decreasing driving current when the second threshold voltage increases.

In another aspect, the present disclosure provides a circuit for driving a light emitting device in a series of cycles of displaying frames of pixel images. The circuit includes a driving transistor having a gate coupled to a first node, a source coupled to a second node connected to an anode of the light emitting device, and a drain connected to a first voltage terminal. The circuit further includes an initialization sub-circuit coupled to a second voltage terminal and the first node and configured to initialize potentials at the first node and the second node under control of a first control signal from a first control terminal. Additionally, the circuit includes a data-input and compensation sub-circuit coupled to the second voltage terminal, a data voltage terminal, the first node, and the second node, and configured to receive a data voltage and change potentials at the first node and the second node under control of the first control signal and a second control signal from a second control terminal. Furthermore, the circuit includes a feedback sub-circuit coupled to a cathode of the light emitting device and the data voltage terminal, being configured to receive the data voltage and compensate a threshold voltage difference of the light-emitting device.

Optionally, the feedback sub-circuit includes a first voltage-difference comparator having a first positive input port coupled to the cathode of the light-emitting device connected to a first constant voltage terminal via a first resistor, a first negative input port and a first output port. The feedback sub-circuit also includes a second voltage-difference comparator having a second negative input port coupled to the first output port, a second positive input port coupled to a second constant voltage terminal via a second resistor, and a second output port being coupled to the second positive input port via a third resistor. Additionally, the feedback sub-circuit includes a third capacitor having one terminal coupled to the data voltage terminal and the other one terminal coupled to the first negative input port of the first voltage-difference comparator and the second output port of the second voltage-difference comparator.

Optionally, the initialization sub-circuit includes a second transistor having a gate coupled to a first control terminal, a source coupled to the first node, and a drain coupled to a second voltage terminal.

Optionally, the data-input and compensation sub-circuit includes a third transistor having a gate coupled to the second control terminal, a source coupled to a third node, and a drain coupled to the data voltage terminal; a fourth transistor having a gate coupled to the first control terminal, a source coupled to the second node, and a drain coupled to the third node; a first capacitor having one terminal coupled to the first node and the other one terminal coupled to the third node; and a second capacitor having one terminal coupled to the second voltage terminal and the other one terminal coupled to the third node.

Optionally, each cycle of the series of cycles includes consecutively a first period, a second period, a third period, and a fourth period. The initialization sub-circuit is configured, in the first period of a current cycle of the series of cycles, to set a voltage level at the first node to a first reference voltage and a voltage level at the second node to zero under a condition that the first voltage terminal is provided at 0V. The second voltage terminal is provided with a first reference voltage at a turn-on voltage level. The first control terminal is provided with a first control signal at the turn-on voltage level to turn the second transistor on to pass the first reference voltage to the first node. The second control terminal is provided with a second control signal at a turn-off voltage level.

Optionally, the initialization sub-circuit and the data-input and compensation sub-circuit are configured in the second period of the current cycle to keep the voltage level at the first node unchanged, to increase the voltage level at the second node to the first reference voltage minus a first threshold voltage of the driving transistor, and to set a voltage level at the third node equal to the voltage level at the second node to store the first threshold voltage to the first capacitor under a condition that the first voltage terminal is provided with a turn-on voltage level. The second voltage terminal is kept at the first reference voltage. The first control signal is kept at the turn-on voltage level. The second control signal is kept at the turn-off voltage level.

Optionally, the data-input and compensation sub-circuit is configured in the third period of the current cycle to input a first data voltage from the data voltage terminal to set the voltage level at the second node unchanged, to change the voltage level at the third node to the first data voltage, and to change the voltage level at the first node to the first data voltage plus the first threshold voltage under a condition that the first voltage terminal and the second voltage terminal are provided at 0V. The first control signal is changed to a turn-off voltage level. The second control signal is changed to a turn-on voltage level.

Optionally, the data-input and compensation sub-circuit and the driving transistor are configured in the fourth period of the current cycle to generate a first driving current flowing through the driving transistor under a condition that the first voltage terminal is changed to the turn-on voltage level. The second voltage terminal is kept at 0V. The first control signal remains to be the turn-off voltage level. The second control signal is changed to the turn-off voltage level. The first driving current is independent of the first threshold voltage yet depended on a second threshold voltage of the light-emitting device.

Optionally, the feedback sub-circuit is operated to output a first voltage difference of the first data voltage at the first positive input port minus a sampling voltage at the first negative input port. The sampling voltage equals to a product of the first driving current and a resistance of a first resistor coupled to the cathode of the light-emitting device.

Optionally, the feedback sub-circuit is operated to output a second voltage difference of a second reference voltage deduced from the second positive input port minus the first voltage difference at the second negative input port.

Optionally, the second voltage difference is feed back to the data voltage terminal via the third capacitor as a compensation voltage to combine with a second data voltage to be inputted into the pixel circuit in the third period of a next cycle.

In yet another aspect, the present disclosure provides a display apparatus including a display panel and a circuit described herein.

Optionally, the display panel is an organic light-emitting diode display panel.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

Many existing OLED display apparatuses have adopted various compensation approaches in designing different pixel circuit in order to solve problems of display abnormity due to the thin-film transistor threshold voltage variation, turn-on voltage difference, driving current difference, and capacitor charging time difference. Nearly all these compensation approaches focus on internal compensations of the pixel circuit such as compensation for a first threshold voltage of a driving transistor, IR drop for connecting the driving transistor, etc. However, the existing compensation approach is rarely focused on external devices such as light-emitting diode which also may cause display variation due to characteristics drift due to environmental change and prolonged working hours. In an example, when the OLED display apparatus is in use for performing a panel self refresh (PSR) operation to save power, a conventional OLED driving scheme used a fixed driving current generated by a timing control internal shift register which is not responsive to variation of the OLED device characteristics such as a second threshold voltage of OLED itself. This may cause unstable image display and result in false image luminance off a target luminance when entering or existing the PSR operation.

Figure 1:
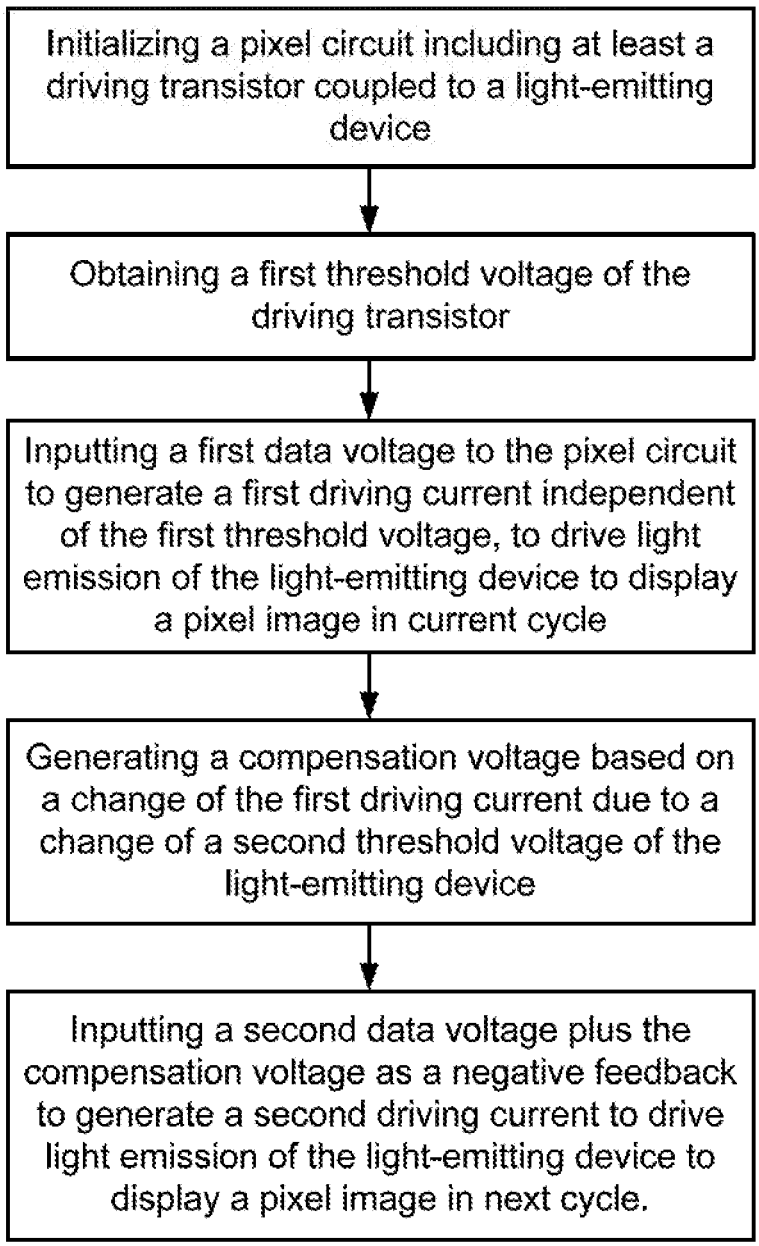
FIG. 1 is flow chart showing a method for providing OLED pixel compensation control according to some embodiments of the present disclosure.

Accordingly, the present disclosure provides, inter alia, a method for providing a compensation on pixel voltage with negative feedback in real time, a circuit for implementing the negative feedback, and a display apparatus having the same that substantially obviate one or more of the problems due to limitations and disadvantages of the related art. In one aspect, the present disclosure provides a method for driving a pixel circuit. FIG. 1 shows a flow chart of a method of driving a pixel circuit to control a light emission of a light-emitting device associated with a pixel (or subpixel) in a display panel.

Referring to FIG. 1, the method includes initializing a voltage setting in the pixel circuit including at least a driving transistor coupled to a light-emitting device. This process is aimed to release charges for driving the light emission of the light-emitting device. In particular, the driving transistor has a source electrode coupled to an anode of the light-emitting device, i.e., a light-emitting diode. The initializing process is to have charges at the source electrode of the driving transistor to be fully cleared in a first period at beginning of a cycle for displaying one frame of pixel image. Each cycle is a time duration that the pixel circuit is configured to generate driving charges based on incoming data signal to drive the light-emitting diode to emit light for displaying a current frame of pixel image before starting a next cycle. The first period of the cycle is also named as an initialization period.

The method further includes obtaining a first threshold voltage of the driving transistor. Through circuit design and controls of several switch transistors coupled with the driving transistor, a threshold voltage of the driving transistor is effectively deduced and stored in a capacitor in a second period of the cycle. The second period is also named as a threshold-voltage retrieve period.

Referring to FIG. 1, the method additionally includes inputting a first data voltage from a data voltage terminal to the pixel circuit to generate a first driving current independent of the first threshold voltage, to drive light emission of the light-emitting device for displaying a pixel image in the current cycle. In an embodiment, inputting the data voltage is performed in a third period of the cycle. The third period is also named as a data-input period. Through circuit design and controls of several switch transistors coupled with the driving transistor, the data voltage is applied to the anode of the light-emitting diode device and the first driving current is generated in the fourth period of the cycle by the driving transistor to flow through the light-emitting device. The driving transistor works in a saturation state so that the first driving current is found to be proportional to square of a difference between the first data voltage and a second threshold voltage of the light-emitting diode device. But, the first driving current is independent from the first threshold voltage of the driving transistor. The fourth period is also a display period.

Referring to FIG. 1 again, the method furthermore includes generating a compensation voltage in the fourth period via a feedback sub-circuit coupled between the data voltage terminal and the light-emitting device based on a change of the first driving current due to a change of the second threshold voltage of the light-emitting device. In an embodiment, the compensation is intended for eliminating effect of the second threshold voltage drift on the change of the driving current generated by substantially in real time. A sampling resistor with comparable resistance of the light-emitting device working in amplification stage is provided to draw a sampling voltage bearing the first driving current. The feedback sub-circuit utilizes two voltage-difference comparators in order to detect a change of the first driving current induced by a drift of the second threshold voltage of the light-emitting device in (at least the fourth period of) the current cycle and to generate a compensation voltage. A first voltage-difference comparator outputs a first voltage difference between the sampling voltage and the first data voltage. A second voltage-difference comparator outputs a second voltage difference between the first voltage difference and a reference voltage. The second voltage difference can be expressed as a product of the change of the first driving current and the sampling resistance.

In the embodiment, the method includes inputting a second data voltage from the data voltage terminal combined with the compensation voltage as a negative feedback to generate a second driving current to drive light emission of the light-emitting device for displaying a pixel image in a next cycle. The second voltage-difference comparator is coupled back to the data voltage terminal via a coupling capacitor to couple the second voltage difference as a compensation voltage back to the inputting data voltage terminal. Optionally, there is no drift in the second threshold voltage, then no change in the first driving current, leading to the first voltage difference to be zero and subsequently the second voltage difference or the compensation voltage to be zero. Optionally, there is a change of the first driving current in the current cycle due to the drift in the second threshold voltage, then the first voltage difference is a non-zero value and subsequently the second voltage difference is a non-zero value, leading a non-zero value in the compensation voltage that is added into a second data voltage inputted in the next cycle (a cycle that is subsequently to the current cycle of driving the pixel circuit for displaying a frame of pixel image after a current frame.

Figure 2:
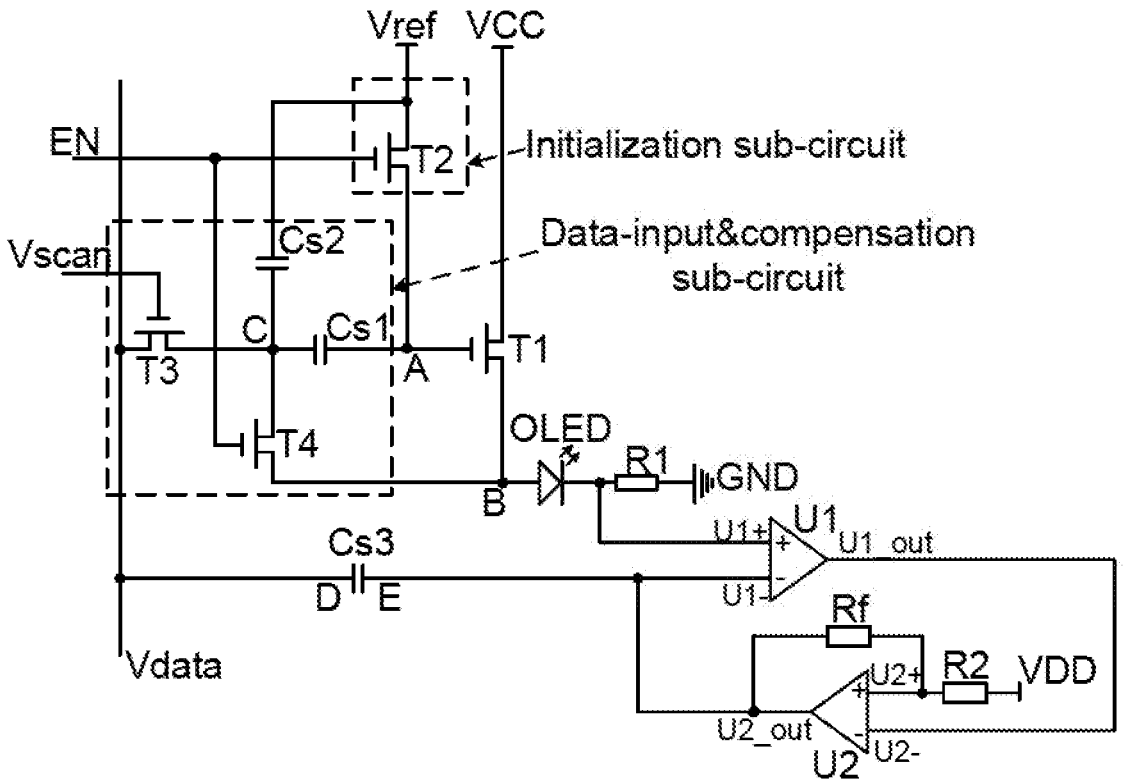
FIG. 2 is an exemplary diagram showing a circuit for providing OLED pixel compensation with negative feedback control according to some embodiments of the present disclosure.

FIG. 2 shows an exemplary diagram of a circuit for driving a light-emitting diode with a negative feedback control for realizing pixel voltage compensation for external characteristic change of the light-emitting diode in substantially real time. Referring to FIG. 2, the circuit includes a driving transistor T1 having a gate coupled to a first node A, a source coupled to a second node B, and a drain connected to a first voltage terminal VCC. The circuit further includes an initialization sub-circuit coupled to a second voltage terminal Vref and the first node A and configured to initialize voltage levels at the first node A and the second node B under control of a first control signal from a first control terminal EN. Optionally, the initialization sub-circuit includes a second transistor T2 having a gate coupled to the first control terminal EN, a source coupled to the first node A, and a drain coupled to the second voltage terminal Vref. Additionally, the circuit includes a data-input and compensation sub-circuit coupled to the second voltage terminal Vref, a data voltage terminal Vdata, the first node A, and the second node B and configured to receive a first data voltage Vdata in a current cycle from the data voltage terminal to change voltage levels at the first node A and the second node B under control of a second control signal from a second control terminal Vscan. Referring to FIG. 2, optionally, the data-input and compensation sub-circuit includes a third transistor T3 having a gate coupled to a second control terminal Vscan, a source coupled to a third node C, and a drain coupled to a data voltage terminal Vdata. The data-input and compensation sub-circuit further includes a fourth transistor T4 having a gate coupled to the first control terminal EN, a source coupled to the second node B, and a drain coupled to the third node C. Furthermore the data-input and compensation sub-circuit includes a first capacitor Cs1 coupled between the first node A and the third node C and a second capacitor Cs2 coupled between the drain of the fourth transistor T4 and the second voltage terminal Vref. The second node B is coupled to a light-emitting device. Optionally, the light-emitting device is an organic light-emitting diode OLED, having an anode coupled to the second node B and a cathode connected to a first constant voltage terminal via a sampling resistor. Optionally, the first constant voltage terminal is provided with a low voltage level. Optionally, the first constant voltage terminal is a ground terminal GND. Optionally, the sampling resistor is a first resistor R1. Optionally, all transistors including T1, T2, T3, and T4 described herein are n-type transistors in the example. In an alternative embodiment, all the transistors can be selected to be p-type transistors.

Referring to FIG. 2 again, the circuit further includes a feedback sub-circuit coupled to the cathode of the light emitting device and the data voltage terminal Vdata. The feedback sub-circuit is configured to receive the data voltage and compensate a threshold voltage difference of the organic light-emitting diode. In an embodiment, the feedback sub-circuit includes a first voltage-difference comparator U1 having a first positive input port $U_{1+}$ coupled to the cathode of the light-emitting diode OLED, a first negative input port $U_{1-}$ coupled via a third capacitor Cs3 to the data voltage terminal Vdata, and a first output port $U_{1_out}$. Furthermore the feedback sub-circuit includes a second voltage-difference comparator U2 having a second negative input port $U_{2-}$ coupled to the first output port $U_{1_out}$, a second positive input port $U_{2+}$ coupled to a second constant voltage terminal VDD, and a second output port $U_{2_out}$ coupled via the third capacitor Cs3 to the data voltage terminal Vdata. Optionally, the second constant voltage terminal VDD is provided with a voltage Vdd that is greater than that provided to the first constant voltage terminal. In an embodiment, the circuit is configured to drive the light-emitting diode to emit light based on a negative feedback generated by the feedback sub-circuit in a series of cycles of displaying frames of pixel images. Each cycle, either a current one or a subsequent next one, includes consecutively a first period, a second period, a third period, and a fourth period as shown substantially in the method described herein.

Figure 3:
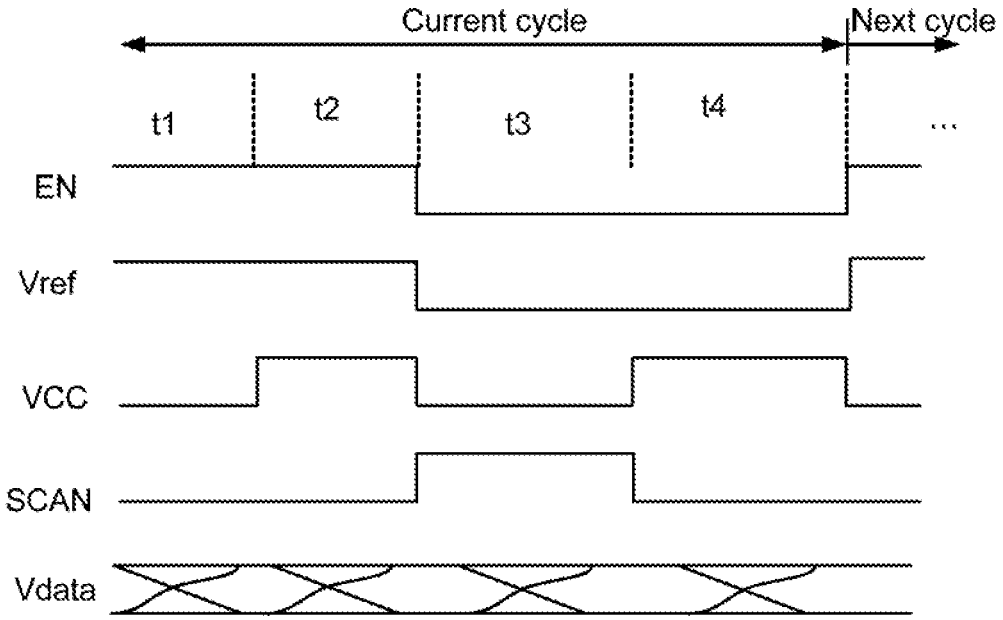
FIG. 3 is a timing diagram of operating the circuit of FIG. 2 according to an embodiment of the present disclosure.

FIG. 3 is a timing diagram of operating the circuit of FIG. 2 to drive an OLED for emitting light in a current cycle before a next cycle of displaying one frame of pixel image according to an embodiment of the present disclosure. In the embodiment, a circuit with negative feedback compensation controls a driving current for driving light emission of the light-emitting diode in substantially real time in a series of consecutive cycles.

Referring to FIG. 2 and FIG. 3, the initialization sub-circuit of the pixel circuit is operated in the first period t1 of a current cycle to initialize voltage settings of multiple circuit nodes based on multiple settings of voltage supplies and control signals. In particular, the first control signal EN is provided with a high voltage level, or a turn-on voltage for transistor. Thus, the second transistor T2 and the fourth transistor T4 are turned on. A voltage level at the first node A is just set to be equal to a voltage level at the drain of the second transistor T2 which is connected to the second voltage terminal Vref. In an embodiment, the voltage at the second voltage terminal Vref is set to be a high voltage level to make the voltage level at the first node A also is a high voltage level which turns the driving transistor T1 on. The first voltage terminal VCC is set to 0V so that a voltage level at the second node B is 0V as it is conducted directly to the drain node of the driving transistor T1 and connected to the first voltage terminal VCC. Since the second node B is also connected to the anode of the light-emitting diode OLED, the charges for driving the pixel to emit light is substantially fully released.

Referring to FIG. 2 and FIG. 3, the initialization sub-circuit and the data-input and compensation sub-circuit of the pixel circuit are operated in the second period t2, following the first period t1, to obtain a first threshold voltage Vth of the driving transistor T1. After the first period t1 for voltage setting initialization, the voltage level at the first node A is $V_A$=Vref. The voltage level at the first voltage terminal VCC is changed from 0V to a high voltage level. The second control terminal Vscan is provided with a low voltage level (i.e., a turn-off voltage level for transistor) so that the third transistor T3 is turned off. Since the driving transistor T1 has been turned on (in the first period t1), carrier in a channel of the driving transistor T1 flow through a barrier from the source electrode to the drain electrode to increase a voltage level of the second node B (i.e., the source of T1).

As the voltage level $V_B$ at the second node B increases, the turning-on voltage of the driving transistor T1 Vth_t1=$V_A$−$V_B$ decreases until it reaches a threshold voltage Vth to have the driving transistor T1 to be turned off. At the turn-off point, the voltage level at the second node B is $V_B$=$V_A$−Vth=Vref−Vth. At the same time, the fourth transistor T4 is on as the first control terminal EN remains to be a high voltage level. The source and the drain of the fourth transistor T4 have a same voltage level. Thus, a voltage level at the third node C is charged to $V_C$=$V_B$=Vref−Vth. Since the first node A and the third node C are two terminals of the first capacitor Cs1, the voltage difference $\Delta V_{Cs1}$ between them is stored in Cs1:

$$\Delta V_{Cs1}=V_A-V_C=V\text{ref}-(V\text{ref}-Vth)=Vth \quad (1)$$

In other words, the first threshold voltage Vth of the driving transistor T1 is deduced and stored in the first capacitor Cs1 as a voltage difference $\Delta V_{Cs1}$.

Referring to FIG. 2 and FIG. 3, the data-input and compensation sub-circuit of the pixel circuit is operated in the third period t3 or a data input period. The first control terminal EN is provided with a low voltage level now so that the second transistor T2 and the fourth transistor T4 are turned off. The first node A and the second node B are all kept in a floating state, $V_A$=Vref and $V_B$ is unchanged. The second control terminal Vscan is changed to a high voltage level to turn the third transistor T3 on. A data voltage, particularly, a first data voltage in the current cycle, is passed from the data voltage terminal Vdata through the third transistor T3 to the third node C. Since the original voltage level $V_C$ at the third node C is Vref−Vth (as seen in the second period t2), the input of the data voltage Vdata causes a change of voltage level $\Delta V_C$ at the third node C to be: $\Delta V_C$=Vdata−(Vref−Vth). But the two terminals of the first capacitor Cs1 remain the same, thus the change of $V_C$ above effectively is coupled to the first node A to lead to a changed voltage level $V_A$ at the first node A:

$$V_A = V\text{ref}\ \Delta V_C = V\text{ref} + V\text{data} - (V\text{ref} - Vth) = V\text{data} + Vth \quad (2)$$

In this period t3, the first voltage terminal VCC is changed to a low voltage level while the second voltage terminal Vref is changed to a low voltage level, the driving transistor T1 is turned off with a reversed bias.

In the next period, t4, or a display period, the data-input and compensation sub-circuit and the driving transistor of the pixel circuit are operated to generate a driving current, or a first driving current of this cycle, through the driving transistor T1. The first voltage terminal VCC now is changed again to the high voltage level to make the driving transistor T1 working in a saturation state to yield a first driving current $I_{data}=(1/2)\times(W/L)\mu C_1[V_{gs}-Vth]^2$ flowing through the driving transistor T1. The gate-to-source voltage $V_{gs}=V_A-V_B$. The voltage level at the gate of the driving transistor T1 is just the voltage level at the first node A: $V_A$=Vdata+Vth. The voltage level at the source of the driving transistor T1 is just the voltage of the second node B: $V_B$, which is also a voltage applied to the anode of the OLED. The voltage of OLED must at least be equal to or greater than a second threshold voltage Vth_oled, which is a minimum driving voltage that initializes the OLED to allow the first driving current $I_{data}$ to be a driving current $I_{oled}$ flowing through the OLED to induce light emission:

$$V_B = Vth_\text{oled} \quad (3)$$

$$I_{oled} = (1/2)\times(W/L)\mu C_1[V\text{data} - Vth_\text{oled}]^2 \quad (4)$$

Here W/L is a ratio of channel width over length of the driving transistor T1, μ is an electron mobility of the driving transistor T1, and $C_1$ is intrinsic capacitance of the driving transistor T1.

As seen in Formula (4), the driving current $I_{oled}$ is independent of the first threshold voltage Vth of the driving transistor while dependent upon the second threshold voltage Vth_oled of the light-emitting diode OLED. The drift of Vth_oled shall cause the change of $I_{oled}$, resulting in an offset of real pixel luminance away from a target pixel luminance. In order to eliminate the affection of the drift of the second threshold voltage Vth_oled, a compensation voltage is required to adjust the input data voltage to follow the drift of Vth_oled.

Referring back to FIG. 2, the compensation voltage for adjusting input data voltage substantially in real time is a feedback additive quantity generated using the feedback sub-circuit coupled between the cathode of the light-emitting diode and the data voltage terminal. By adding a first resistor R1 between the cathode of the OLED and the first constant voltage terminal GND, a sampling voltage effectively is drawn by $I_{oled}\times R1$. The first resistor is worked as a sampling resistor. This sampling voltage is applied to a first positive input port $U_{1+}$ of a first voltage-difference comparator U1. At the same time, a first negative input port $U_{1-}$ of U1 is coupled to the data voltage terminal to incorporate the first data voltage Vdata, which is an input data signal in the current cycle:

$$U_{1+} = I_{oled}\times R1$$

$$U_{1-} = V\text{data}$$

Then the first voltage-difference comparator U1 outputs a first voltage difference $U_{1_out}$ at a first output port:

$$U_{1_out} = U_{1+} - U_{1-} = I_{oled}\times R1 - V\text{data}$$

Referring to FIG. 2, the first voltage difference $U_{1_out}$ is passed to a second negative input port $U_{2-}$ of a second voltage-difference comparator U2:

$$U_{2-} = U_{1_out} = I_{oled}\times R1 - V\text{data}.$$

Referring to FIG. 2, the second voltage-difference comparator U2 includes a second positive input port $U_{2+}$ configured to couple with a second constant voltage terminal VDD in association with a second resistor R2 connected in series to the second constant voltage terminal VDD and a feedback (third) resistor Rf connected in parallel with the second voltage-difference comparator U2 between the second positive input port $U_{2+}$ and a second output port $U_{2_out}$. Effectively the input voltage at the second positive input port $U_{2+}$ is:

$$U_{2+} = F(R2, Rf)\times Vdd.$$

Here F(R2, Rf) is amplification coefficient associated with the second voltage-difference comparator U2 which acts as a close-loop amplifier and Vdd is a fixed voltage provided to the second constant voltage terminal VDD. Optionally, Vdd≥0V.

When there is no drift of the second threshold voltage Vth_oled in the current cycle, no feedback is needed to be fed to a next cycle. Thus, the second output port $U_{2_out}$ should output 0V, i.e., $U_{2+}=U_{2-}$. In case there is a change in Vth_oled in the current cycle, the first driving current will also change, e.g., to $I'_{oled}$. Then, the input voltages respectively at the first positive input port and the first negative input port, the first voltage difference at the first output port are, $$U'_{1+} = I'_{oled}\times R1$$

$$U'_{1-} = V\text{data}$$

$$U'_{1_out} = I'_{oled}\times R1 - V\text{data}$$

The second negative input port $U_{2-}$ of the second voltage-difference comparator U2 is receiving the first voltage difference $U'_{1_out}$ outputted in the current cycle. The output voltage at the second output port $U_{2_out}$ of the second voltage-difference comparator U2 is given by $$\begin{aligned} U_{2_out} &= U_{2+} - U_{2-} = F(R2, Rf)\times Vdd - (I'_{oled}\times R1 - Vdata) \quad (5) \\ &= I_{oled}\times R1 - Vdata - (I'_{oled}\times R1 - Vdata) \\ &= (I_{oled} - I'_{oled})\times R1 = \Delta L_{oled}\times R1 \end{aligned}$$

Referring to FIG. 2, the second output port $U_{2_out}$ is coupled to one electrode E of a third capacitor Cs3 which has another electrode D coupled to the data voltage terminal. Therefore, whenever there is voltage change in the second output port, the data voltage terminal voltage Vdata is responsively incorporated the voltage change. In other words, the output voltage at the second output port $U_{2_out}$ of the second voltage-difference comparator U2 detected in this cycle [n] becomes a feedback voltage added to compensate the data voltage Vdata to be inputted for a subsequent next cycle [n+1]:

$$V'\text{data}[n+1]=V\text{data}[n+1]+U2_\text{out}[n] \quad (6)$$

Here [n] represents a current cycle, and [n+1] a subsequent next cycle.

From the Formula (5), when there is no change of driving current $\Delta L_{oled}$ induced by a drift in the Vth_oled, then the output voltage at the second output port $U_{2_out}$ of the second voltage-difference comparator U2 will be 0V. In this case, referring to FIG. 2, there is no feedback voltage being incorporated as a feedback into the data voltage terminal to combine with the data voltage to be inputted into the pixel circuit in a next cycle for displaying another frame of pixel image. However, whenever the OLED characteristic changes cause the second threshold voltage Vth_oled to drift in a current cycle, either increasing or decreasing, the output $U_{2_out}$ of the second voltage-difference comparator U2 will be a non-zero value. If the Vth_oled decreases in the cycle, the channel carrier in the OLED will move faster to cause the driving current to increase, i.e., $I_{oled}<I'_{oled}$, the output $U_{2_out}<0$ will be a negative value added to the data voltage for a next cycle. Therefore, the compensated data voltage is reduced to drag the driving current $I_{oled}$ (second driving current) down for the next cycle to effectively eliminate the affection of the decrease of the second threshold voltage Vth_oled. Alternatively, if the Vth_oled increases in the cycle, the channel carrier in the OLED will move slower to cause the driving current to decrease, i.e., $I_{oled}>I'_{oled}$, the output $U_{2_out}>0$ will be a positive value added to the data voltage for a next cycle. Therefore, the compensated data voltage is enlarged to push the driving current $I_{oled}$ (second driving current) higher for the next cycle to effectively eliminate the affection of the increase of the second threshold voltage Vth_oled. No matter the Vth_oled of the OLED drifts in either direction, the method disclosed herein is able to complete a compensation to the Vth_oled substantially in real time.

In yet another aspect, the present disclosure provides a display apparatus including a display panel and a circuit of FIG. 2 described herein. In an example, the circuit includes a pixel circuit coupled to an anode of a light-emitting diode associated with a subpixel in the display panel and configured to receive a data voltage from a data voltage terminal to control a first driving current to drive the light-emitting diode to emit light for displaying a frame of pixel image in a current cycle. The circuit further includes a feedback sub-circuit coupled between a cathode of the light-emitting diode and the data voltage terminal and configured to generate a compensation voltage based on any change of the first driving current due to characteristic change of the light-emitting diode and add this compensation voltage as a negative feedback to the data voltage to be inputted into the pixel circuit for a subsequent next cycle. Optionally, the light-emitting diode is an organic light-emitting diode (OLED). Optionally, the light-emitting diode is OLED having a cathode configured to be connected to a sampling resistor in series with a ground port. Optionally, the display panel is an OLED display panel. Examples of appropriate display apparatuses include, but are not limited to, an electronic paper, a mobile phone, a tablet computer, a television, a monitor, a notebook computer, a digital album, a GPS, etc. In one example, the display apparatus is a smart watch. Optionally, the display apparatus is an organic light emitting diode display apparatus.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A method for driving a pixel circuit with feedback compensation in consecutive cycles comprising:

initializing a voltage setting in the pixel circuit including at least a driving transistor coupled to a light-emitting device;

obtaining a first threshold voltage of the driving transistor;

inputting a first data voltage from a data voltage terminal to the pixel circuit to generate a first driving current independent of the first threshold voltage, to drive light emission of the light-emitting device in a current cycle;

generating a compensation voltage via a feedback sub-circuit coupled between the data voltage terminal and the light-emitting device based on a change of the first driving current due to a change of a second threshold voltage of the light-emitting device; and inputting a second data voltage from the data voltage terminal combined with the compensation voltage as a negative feedback to generate a second driving current to drive light emission of the light-emitting device for displaying a pixel image in a next cycle;

wherein each of the current cycle and the next cycle is one of two consecutive durations for the light-emitting device to emit light for producing two consecutive frames of pixel images under a progressive scanning scheme, each duration comprising consecutively a first period, a second period, a third period, and a fourth period;

wherein the initializing the pixel circuit comprises releasing charges in a source electrode of the driving transistor in the first period of the current cycle, the source electrode being coupled to an anode of the light-emitting device;

wherein the obtaining the first threshold voltage of the driving transistor comprises setting a voltage level at a first electrode of a first capacitor in the pixel circuit to a first reference voltage in the second period of the current cycle and storing the first threshold voltage as a voltage difference between the first electrode and a second electrode of the first capacitor, wherein the first electrode of the first capacitor is coupled to a gate electrode of the driving transistor; and wherein the inputting the first data voltage comprises transferring the first data voltage to the second electrode of the first capacitor in the third period of the current cycle and resetting the voltage level at the first electrode of the first capacitor to a sum of the first data voltage and the first threshold voltage.

2. The method of claim 1, wherein the resetting the voltage level at the first electrode of the first capacitor comprises making the voltage level at the source electrode of the driving transistor to at least a second threshold voltage in the fourth period of the current cycle and generating the first driving current through the driving transistor.

3. A method for driving a pixel circuit with feedback compensation in consecutive cycles comprising:

initializing a voltage setting in the pixel circuit including at least a driving transistor coupled to a light-emitting device;

obtaining a first threshold voltage of the driving transistor;

inputting a first data voltage from a data voltage terminal to the pixel circuit to generate a first driving current independent of the first threshold voltage, to drive light emission of the light-emitting device in a current cycle;

generating a compensation voltage via a feedback sub-circuit coupled between the data voltage terminal and the light-emitting device based on a change of the first driving current due to a change of a second threshold voltage of the light-emitting device; and inputting a second data voltage from the data voltage terminal combined with the compensation voltage as a negative feedback to generate a second driving current to drive light emission of the light-emitting device for displaying a pixel image in a next cycle;

wherein each of the current cycle and the next cycle is one of two consecutive durations for the light-emitting device to emit light for producing two consecutive frames of pixel images under a progressive scanning scheme, each duration comprising consecutively a first period, a second period, a third period, and a fourth period;

wherein the generating the compensation voltage comprises:

using a first resistor to obtain a first sampling voltage equal to the first driving current multiplying a resistance of the first resistor in the fourth period of the current cycle;

inputting the first sampling voltage to a first positive input terminal of a first voltage-difference comparator in the feedback sub-circuit; and coupling the first data voltage to a first negative input terminal of the first voltage-difference comparator to output a first voltage difference between the first sampling voltage and the first data voltage.

4. The method of claim 3, further comprising inputting the first voltage difference to a second negative input terminal of a second voltage-difference comparator in the feedback sub-circuit;

coupling a second reference voltage to a second positive input terminal of the second voltage-difference comparator; and outputting a second voltage difference between the second reference voltage and the first voltage difference; wherein the second voltage difference is proportional to the change of the first driving current due to the change of the second threshold voltage of the light-emitting device.

5. The method of claim 4, further comprising coupling the second voltage difference as the compensation voltage to the data voltage terminal to be added with the second data voltage.

6. The method of claim 5, wherein the compensation voltage is zero when the second threshold voltage remains substantially unchanged, the compensation voltage is a negative value to compensate an increasing driving current when the second threshold voltage decreases, and the compensation voltage is a positive value to compensate a decreasing driving current when the second threshold voltage increases.

7. A circuit for driving a light emitting device in a series of cycles of displaying frames of pixel images comprising:

a driving transistor having a gate coupled to a first node, a source coupled to a second node connected to an anode of the light emitting device, and a drain connected to a first voltage terminal;

an initialization sub-circuit coupled to a second voltage terminal and the first node and configured to initialize potentials at the first node and the second node under control of a first control signal from a first control terminal;

a data-input and compensation sub-circuit coupled to the second voltage terminal, a data voltage terminal, the first node, and the second node and configured to receive a data voltage and change potentials at the first node and the second node under control of the first control signal and a second control signal from a second control terminal;

a feedback sub-circuit coupled to a cathode of the light emitting device and the data voltage terminal, being configured to receive the data voltage and compensate a threshold voltage difference of the light-emitting device;

wherein the feedback sub-circuit comprises:

a first voltage-difference comparator having a first positive input port coupled to the cathode of the light-emitting device connected to a first constant voltage terminal via a first resistor, a first negative input port and a first output port;

a second voltage-difference comparator having a second negative input port coupled to the first output port, a second positive input port coupled to a second constant voltage terminal via a second resistor, and a second output port being coupled to the second positive input port via a third resistor; and a third capacitor having one terminal coupled to the data voltage terminal and the other one terminal coupled to the first negative input port of the first voltage-difference comparator and the second output port of the second voltage-difference comparator.

8. The circuit of claim 7, wherein the initialization sub-circuit comprises:

a second transistor having a gate coupled to the first control terminal, a source coupled to the first node, and a drain coupled to the second voltage terminal;

wherein the data-input and compensation sub-circuit comprises:

a third transistor having a gate coupled to the second control terminal, a source coupled to a third node, and a drain coupled to the data voltage terminal;

a fourth transistor having a gate coupled to the first control terminal, a source coupled to the second node, and a drain coupled to the third node;

a first capacitor having one terminal coupled to the first node and the other one terminal coupled to the third node; and a second capacitor having one terminal coupled to the second voltage terminal and the other one terminal coupled to the third node.

9. The circuit of claim 8, wherein the initialization sub-circuit is configured, in a first period of a current cycle of the series of cycles, to set a voltage level at the first node to a first reference voltage and a voltage level at the second node to zero under a condition that the first voltage terminal is provided at 0V, wherein the second voltage terminal is provided with a first reference voltage at a turn-on voltage level, the first control terminal is provided with a first control signal at the turn-on voltage level to turn the second transistor on to pass the first reference voltage to the first node, and the second control terminal is provided with a second control signal at a turn-off voltage level.

10. The circuit of claim 9, wherein the initialization sub-circuit and the data-input and compensation sub-circuit are configured, in a second period of the current cycle, to keep the voltage level at the first node unchanged, to increase the voltage level at the second node to the first reference voltage minus a first threshold voltage of the driving transistor, and to set a voltage level at the third node equal to the voltage level at the second node to store the first threshold voltage to the first capacitor under a condition that the first voltage terminal is provided with a turn-on voltage level, wherein the second voltage terminal is kept at the first reference voltage, the first control signal is kept at the turn-on voltage level, and the second control signal is kept at the turn-off voltage level.

11. The circuit of claim 10, wherein the data-input and compensation sub-circuit is configured, in a third period of the current cycle, to input a first data voltage from the data voltage terminal to set the voltage level at the second node unchanged, to change the voltage level at the third node to the first data voltage, and to change the voltage level at the first node to the first data voltage plus the first threshold voltage under a condition that the first voltage terminal and the second voltage terminal are provided at 0V, wherein the first control signal is changed to a turn-off voltage level, and the second control signal is changed to a turn-on voltage level.

12. The circuit of claim 11, wherein the data-input and compensation sub-circuit and the driving transistor are configured, in a fourth period of the current cycle, to generate a first driving current flowing through the driving transistor under a condition that the first voltage terminal is changed to the turn-on voltage level, wherein the second voltage terminal is kept at 0V, the first control signal remains to be the turn-off voltage level, and the second control signal is changed to the turn-off voltage level, wherein the first driving current is independent of the first threshold voltage yet depended on a second threshold voltage of the light-emitting device.

13. The circuit of claim 12, wherein the first voltage-difference comparator is configured to output a first voltage difference of a sampling voltage at the first positive input port minus the first data voltage at the first negative input port, wherein the sampling voltage equals to a product of the first driving current and a resistance of a first resistor coupled to the cathode of the light-emitting device;

the second voltage-difference comparator is configured to output a second voltage difference of a second reference voltage deduced from the second positive input port minus the first voltage difference at the second negative input port; and the second voltage difference is feed back to the data voltage terminal via the third capacitor as a compensation voltage to combine with a second data voltage to be inputted into the pixel circuit in a third period of a next cycle.

14. A display apparatus comprising a display panel and a circuit of claim 7.

15. The display apparatus of claim 14, wherein the display panel is an organic light-emitting diode display panel.

* * * * *